United States Patent [19]

Christenson

[11] Patent Number: 5,056,924

[45] Date of Patent: Oct. 15, 1991

[54] SYSTEM FOR MIXING AND DISPENSING CONCRETE

[75] Inventor: Ronald E. Christenson, Kasson, Minn.

[73] Assignee: McNeilus Truck and Manufacturing, Inc., Dodge City, Minn.

[21] Appl. No.: 471,272

[22] Filed: Jan. 26, 1990

[51] Int. Cl.[5] ..... B01F 7/08

[52] U.S. Cl. ..... 366/59; 366/229; 416/241 A

[58] Field of Search ..... 366/57, 59, 62, 227, 366/228, 58; 416/241 A; 198/660, 677, 957, 666; 69/30; 222/240, 241, 412; 210/374, 377

[56] References Cited

U.S. PATENT DOCUMENTS

| | | | |
|---|---|---|---|
| 1,775,888 | 9/1930 | Christian | 198/666 |
| 2,118,289 | 5/1938 | Birkenbeuel | 198/666 |
| 2,288,372 | 6/1942 | Rump | 366/228 |
| 2,810,558 | 10/1957 | Kerridge | 366/57 |
| 2,815,852 | 12/1957 | Harrer | 198/666 |
| 2,865,616 | 12/1958 | Masek . | |
| 2,993,350 | 7/1961 | Smith | 366/228 X |
| 3,280,963 | 10/1966 | Kirker, Jr. | 416/241 A X |
| 3,306,588 | 2/1967 | Reid | 416/241 A X |
| 3,328,006 | 6/1967 | Buelow et al. . | |
| 3,602,604 | 8/1971 | Ronellenfitch | 416/241 A X |
| 3,795,121 | 3/1974 | Cressman | 69/30 |
| 3,843,101 | 10/1974 | Green . | |
| 4,293,228 | 10/1981 | Swisher, Jr. et al. | 360/57 X |
| 4,506,983 | 3/1985 | Marr | 366/59 X |
| 4,525,070 | 6/1925 | Gressette, Jr. | 366/57 X |
| 4,875,781 | 10/1987 | Raska | 366/228 X |
| 4,940,334 | 7/1990 | Musil . | |

FOREIGN PATENT DOCUMENTS

| | | |
|---|---|---|
| 1071186 | 2/1980 | Canada . |
| 0077838 | 5/1983 | European Pat. Off. . |
| 0211279 | 2/1987 | European Pat. Off. . |
| 0310561 | 4/1989 | European Pat. Off. . |
| 2255351 | 5/1974 | Fed. Rep. of Germany . |
| 1364222 | 12/1964 | France . |

OTHER PUBLICATIONS

Cover page of MTM ® Mixer Parts Catalog.
Page 20 of MTM ® Mixer Parts Catalog.
5 pages of specification re. physical properties of nylon materials.

*Primary Examiner*—Frankie L. Stinson
*Attorney, Agent, or Firm*—Merchant, Gould, Smith, Edell, Welter & Schmidt

[57] ABSTRACT

An assembly which is adapted for mounting inside a mixing drum and a mobile system for mixing and dispensing concrete includes fin structure for mixing and guiding a substance when the mixing drum is rotated. The fin structure is constructed of a lightweight polymeric material which is resistant to abrasion and is many times lighter than steel. As a result, the weight of such a system is reduced in comparison to systems which were heretofore known. Preferably, the fin structure is fabricated from a polymer which tends to wear smooth rather than rough, which increases the cleanability of the fin structure over its entire design life. Novel structure for securing the fin structure to an outer wall of the mixing drum is also disclosed.

38 Claims, 4 Drawing Sheets

SYSTEM FOR MIXING AND DISPENSING CONCRETE

BACKGROUND OF THE INVENTION

1. Field of the Invention

This invention relates to mobile systems for mixing and dispensing concrete. More specifically, this invention relates to an improved fin structure for use within the mixing drums in such systems which will increase the efficiency of a system, as well as lowering maintenance and manufacturing costs.

2. Description of the Prior Art

Concrete mixing trucks such as those manufactured by the assignee of this invention, McNeilus Truck and Manufacturing Corporation of Dodge Center, Minnesota, are widely used in the construction industry for preparing and transporting a concrete mixture to a desired construction site.

A mixing truck typically includes a rotatable mixing drum which has metallic fins or agitators mounted inside for mixing and directing the movement of a concrete mixture therein. Ordinarily, such fins have a helical configuration which will tend to mix concrete when the mixing drum is rotated in a first direction, and urge the concrete toward a discharge chute when the mixing drum is turned in an opposite direction.

During operation of such trucks, a great deal of abrasive friction is generated between the mixing fins and the various abrasive components of the concrete mixture which is being transported. As a result, mixing fins typically wear out long before the outer wall of the mixing drum itself does. Accordingly, a mixing drum must either be discarded or rebuilt with new fins if it is to achieve the full extent of its own design life. Such refitting is commonly done throughout the industry, and it is a relatively expensive, time-consuming process.

Another problem with metallic fins is their tendency to oxidize or corrode, which makes them difficult to clean after use. As a result, concrete often builds up on the fins after each use. This reduces the usable volume of the drum and the efficiency of the fins during use. It also compounds the difficulty of cleaning the inside of the drum and the fins as time goes on.

Despite the above-noted problems, trucks with metallic mixing fins have been designed to operate fairly well in the past. However, it is generally recognized that the efficiency of a mixing system as a whole will be enhanced if such problems could be ameliorated.

It is clear, then, that there has existed a long and unfilled need in the art for mixing fins which have greater resistance to abrasion, which do not become roughened as they wear, and which are more lightweight than mixing fins which have been heretofore known.

SUMMARY OF THE INVENTION

Accordingly, it is an object of this invention to provide a fin for use in a mixing system which is more resistant to abrasion and corrosion than mixing fins which are currently in use.

It is further an object of the invention to provide an improved mixing fin which will tend to remain smooth as it is subjected to wear.

It is yet further an object of the invention to provide a mixing fin which is lighter in weight than those heretofore known.

In order to achieve these and other objects of the invention, an assembly according to the invention is adapted for mounting inside a mixing space which is defined by an outer wall of a mixing drum in a mobile system for mixing and dispensing a mixture such as concrete. The assembly may include fin structure within the mixing space for mixing and guiding a substance when the mixing drum is rotated, the fin structure being constructed of a lightweight polymeric material which is resistant to abrasion, whereby the weight of the system is reduced in comparison to systems which were heretofore known; and structure for securing the fin structure to the outer wall.

According to a second aspect of the invention, a mobile system for mixing and dispensing a mixture such as concrete may include a vehicle and a mixing drum, in conjunction with the structure that is discussed above.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
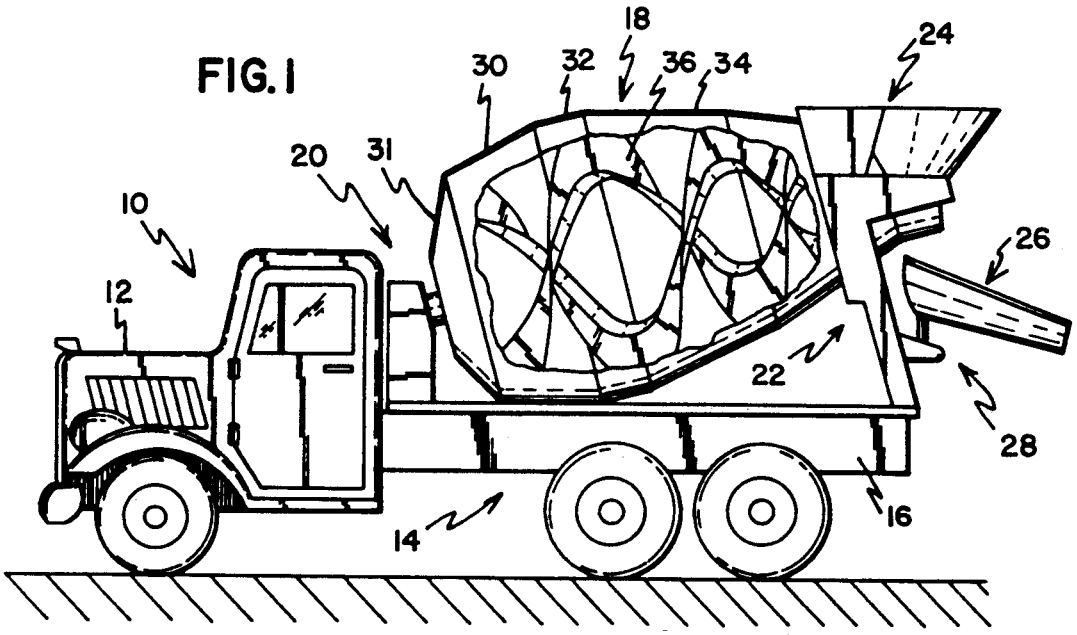
FIG. 1 is a side elevational view of a mobile system for mixing and dispensing concrete according to a first preferred embodiment of the invention.

Referring now to the drawings, wherein like reference numerals designate corresponding structure throughout the views, and referring in particular to FIG. 1, a mixing truck 10 constructed according to a first preferred embodiment of the invention includes a cab portion 12 and a rear portion 14 which has a main frame 16. A mixing drum 18 is mounted for rotation on a front support frame 20 and rear support frame 22, both of which are integral with main frame 16. A rearward portion of mixing drum 18 is positioned adjacent a discharge mechanism 24 which includes a funnel for loading concrete components into mixing drum 18 as well as a portion for guiding mixed concrete into a main chute 26, as is well known in the art. Main chute 26 is supported relative to rear support frame 22 by a pivot joint 28, which enables main chute 26 to be positioned over a set of forms or other desired location for the mixed concrete. It will be appreciated by those skilled in the art that the other various details of truck 10, including but not limited to the engine, drive train and hydraulic system for operating mixing drum 18, are well known and readily available to the skilled artisan.

Figure 2:
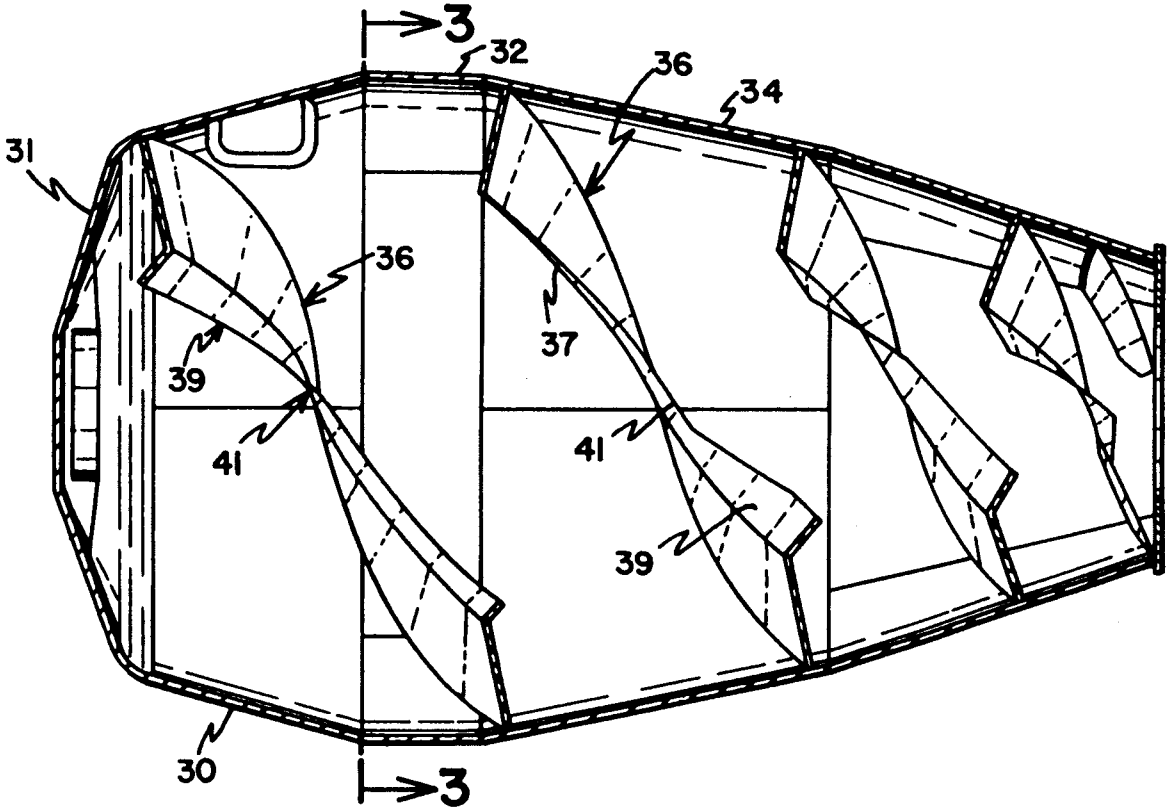
FIG. 2 is a fragmentary elevational view of a portion of the mixing system illustrated in FIG. 1.

As may be seen in FIGS. 1 and 2, mixing drum 18 includes a head portion 31, a front cone portion 30, a belly portion 32, and a rear cone portion 34 which terminates at the end of truck 10 which supports the discharge mechanism 24. An improved helical mixing fin 36 is mounted to an inner surface of an outer wall 38 of mixing drum 18, as will be described in greater detail below. As may be seen in FIG. 2, mixing fin 36 includes a rearwardly curving fin portion 37, a forwardly curving fin portion 39 which preferably is in head portion 31 and front cone portion 30, and a transitional fin portion 41 which connects the rearwardly curving portion 37 and the forward curving portion 39. It will be appreciated that a concrete mixture will be agitated by the fin portions 37, 39, 41 when mixing drum 18 is caused to rotate in a first direction, while the fin portions will urge the mixture toward discharge mechanism 24 when the mixing drum 18 is rotated in a second, opposite direction. The forwardly curving fin portion 39 acts to help lift and toss the mixture toward the middle of drum 18 when drum 18 is rotated to mix the material.

Figure 8:
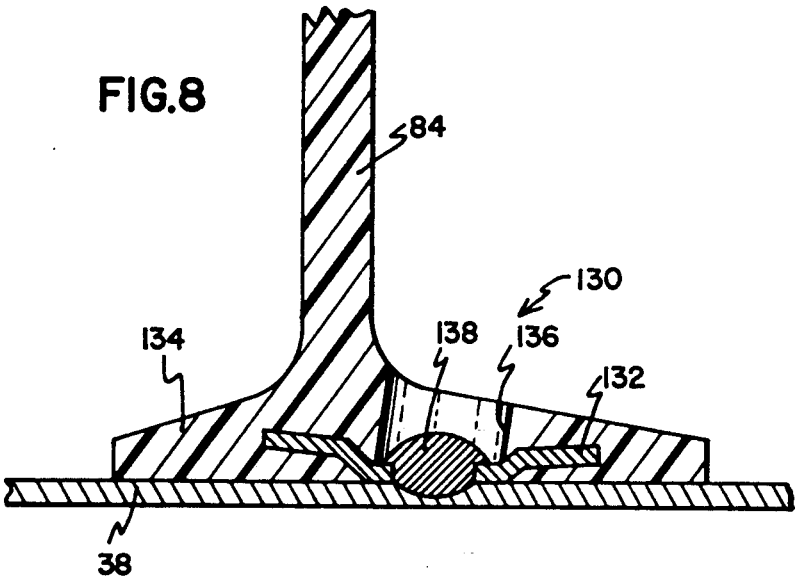
FIG. 8 is a cross sectional view similar to FIG. 4, which shows an alternative embodiment to the structure depicted in FIG. 4.
Figure 3:
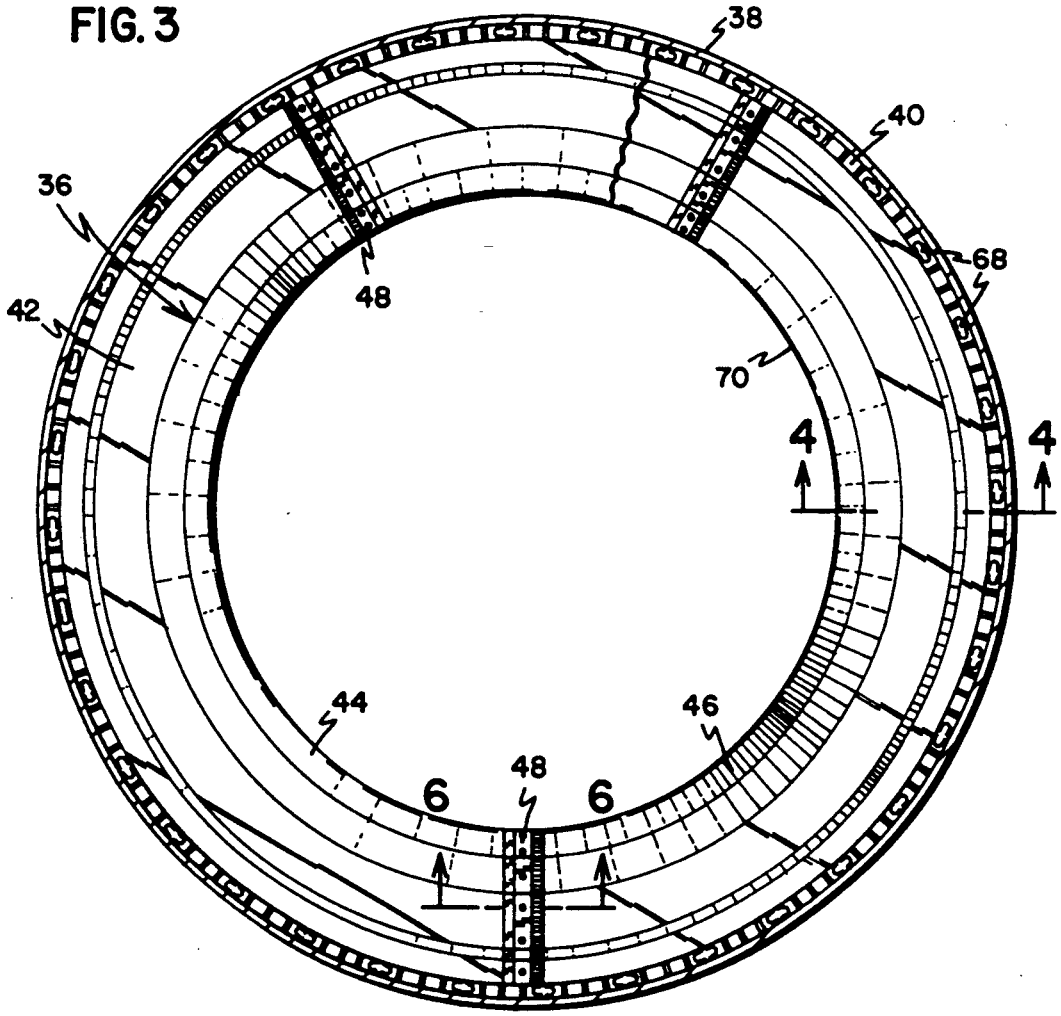
FIG. 3 is a cross sectional view taken along lines 3—3 in FIG. 2.

Referring now to FIG. 3, the various portions of helical mixing fin 36 are secured to the wall 38 of mixing drum 18 by a metal insert 40, in a manner that will be described below in further detail with reference to FIGS. 4, 5 and 8. As may be seen in FIGS. 3 and 4, the helical mixing fin 36 includes a fin portion 42 which is fabricated from a lightweight polymeric material. Preferably, plastic fin portion 42 is fabricated from a fiber reinforced polymer which is relatively lightweight and which will tend to remain smooth after wear. The most preferred material at the time application for patent was made is polyurethane, although it is to be understood that nylons and other polymers having the requisite characteristics could just as preferably be used. Preferably, the polymer used to form plastic fin portion 42 is also fiber-reinforced for greater strength. It is important that the outer surfaces of fin portion 42 be smooth, so as to facilitate efficient removal of material from the fins after use.

As may be seen in FIG. 3, mixing fin 36 is made up of several sections, among them a first fin section 44 and a second fin section 46. The different sections 44, 46 are joined together by a number of fin connection joints 48, one of which is shown in cross section in FIG. 6 and will be described in greater detail below.

Figure 5:
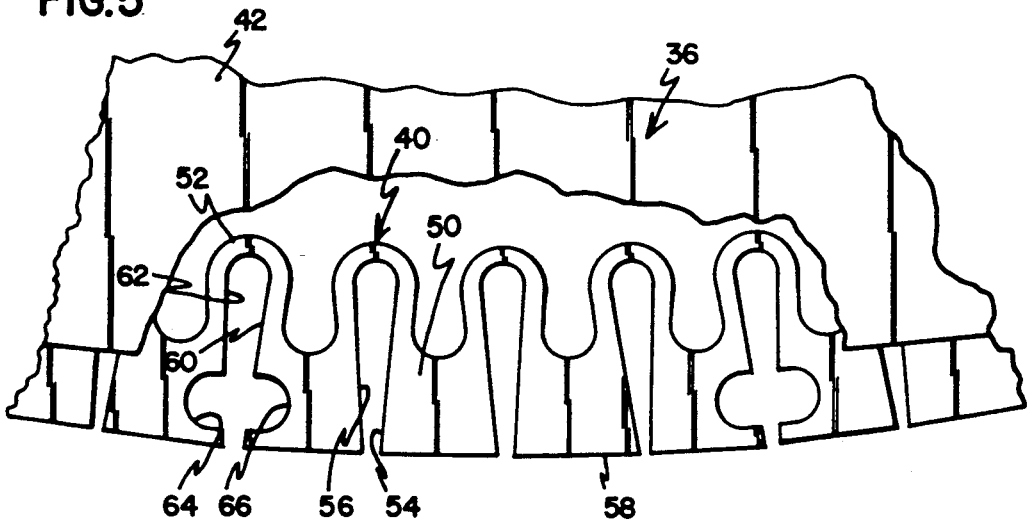
FIG. 5 is a cutaway view illustrating a portion of the structure shown in FIG. 3.

Looking now to FIG. 5, a first preferred embodiment of metal insert 40 includes a number of substantially flat anchor members 50, which are formed in the shape of a truncated triangle. Each of the anchor members 50 are flexibly connected to adjacent anchor members 50 via a connecting hoop portion 52. The connecting hoop portions 52 are preferably unitary with anchor members 50 and are formed of a resilient metallic material such as steel. Each of the anchor members 50 has a first side surface 54 and a second side surface 56 which is opposite the first side surface 54 of an adjacent anchor member 50. The anchor members 50 further each have a planar end surface 58 which is adapted for connecting to the outer wall 38 of mixing drum 18 in a manner that will be described in greater detail below. Periodically along the length of insert 40 are anchor members which have a second type of first side surfaces 60 and adjacent second side surfaces 62. The modified type of first side surface 60 includes a recessed surface 64 that is opposite a second recessed surface 66 in the modified first side surface 60. The first recessed surface 64 and second recessed surface 66 together define a washout hole 68 through which fluid may pass. Washout holes 68 are particularly advantageous when the interior of mixing drum 18 is rinsed out after use.

Figure 4:
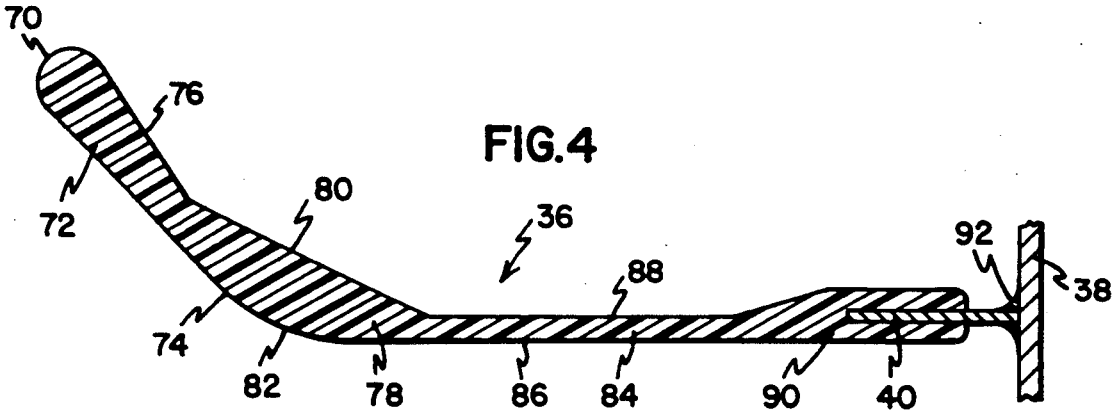
FIG. 4 is a cross sectional view taken along lines 4—4 in FIG. 3.

Referring now to FIG. 4, mixing fin 36 includes an inside edge 70 which defines an orifice through which material may pass. This orifice is visible in FIG. 3. As may be seen in FIG. 4, mixing fin 36 includes, in cross section, a curved inner fin portion 72 which is defined by a first outer surface 74 and a first inside surface 76. Unitary with curved inner fin portion 72 is a reinforced bend portion 78 which is defined by a second inside surface 80 and a radiused outer surface 82. A substantially straight blade portion 84 is unitary with a second end of reinforced bend portion 78, and is defined by a second outer surface 86 and a third inside surface 88. An anchor portion 90 is unitary with blade portion 84 and is molded about the metal insert 40, as is discussed above with reference to FIG. 5. The end surfaces 58 of the various anchor members 50 in metal insert 40 are secured to the outer wall 38 of mixing drum 18 via a fillet weld 92.

In constructing mixing fin 36 out of a polymeric material, the optimum thickness of curved inner fin portion 72 is considered to be within the range of 0.5 inches–3 inches, with a most preferred dimension of 1.125 inches. The preferred thickness of reinforced bend portion 78 is from 0.5 inches–1.5 inches, with a preferred thickness of 0.875 inches. Blade portion 84 is preferably constructed to be 0.35 inches, but may thick as 1 inch. Anchor portion 90 may be between 0.5–1 inches thick, with a preferred thickness of 0.875 inches. Fillet welds 92 preferably have a radius from 3/16–¼ inch.

Figure 6:
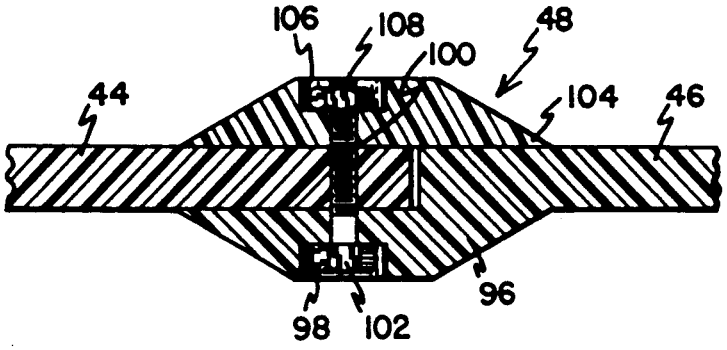
FIG. 6 is a cross sectional view taken along lines 6—6 in FIG. 3.

Looking now to FIG. 6, the construction of a fin connection joint 48 will now be described. As is shown in FIG. 6, second fin section 46 is provided with a reinforced offset portion 96 which has a step defined therein for receiving an end portion of first fin section 44. Reinforced offset portion 96 has a countersunk recess 98 defined therein for receiving the head 102 of a bolt 100. Bolt 100 passes through a bore defined in reinforced offset portion 96 and a matching bore in first fin section 44. A reinforcement strip 104 extends along an interface between the first fin section 44 and second fin section 46. Bolt 100 extends through a bore in reinforcement strip 104, as is shown in FIG. 6. A countersunk recess 106 is defined in an outside surface of reinforcement strip 104 for receiving a nut 108 which threadedly engages bolt 100 so as to secure reinforcement strip 104, first fin section 44, and the reinforced offset portion 96 of second fin section 46 as a single unit. The advantage provided by countersunk recesses 98, 106 is that concrete mixture is less likely to adhere to head 102 and nut 108.

Figure 7:
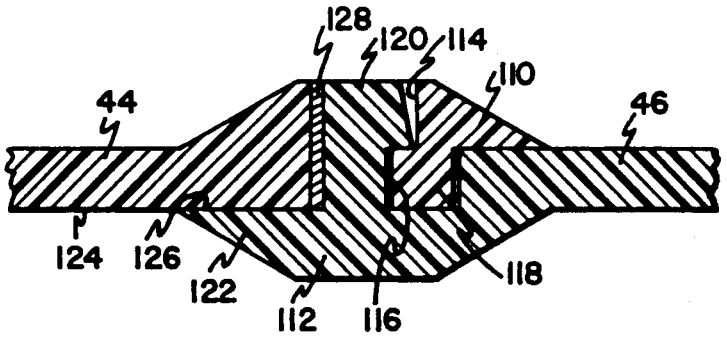
FIG. 7 is a cross sectional view similar to that depicted in FIG. 6, which shows an alternative embodiment of the feature of the invention which is illustrated in FIG. 6.

Referring now to FIG. 7, an alternative construction of fin connection joint 48 will now be described. In this embodiment, first fin portion 44 is provided with a snap socket 110 and second fin section 46 is provided with a snap element 112. A first stepped circular recess 114 is defined in first fin section 44 for receiving a second, circular pawl 120 of snap element 112. Likewise, a second, stepped recess 116 is defined in second fin section 46 for receiving a first, circular pawl 118 which is partially defined by the stepped recess 116 on snap socket 110. First pawl 118 is constructed to be engaged by second pawl 120 when snap element 112 is urged toward snap socket 110. Such urging is effected by a locking key 128 which is insertable into a gap between first fin section 44 and the second pawl 120 of second fin section 46. As may be seen in FIG. 7, snap element 112 is preferably supported on an offset portion 122 of second fin section 46. The offset portion 122 supports a lower surface 124 of first fin section 44 by means of a flat surface 126 which is adapted to bear against lower surface 124.

Looking now to FIG. 8, an alternative embodiment to the structure previously discussed with reference to FIG. 4 will now be described. In the embodiment of FIG. 8, an alternative fin mounting arrangement 130 includes a mounting insert 132 which is molded into a thickened base portion 134 of mixing fin 36. Mounting insert 132 is in the preferred mode a metallic washer-shaped element that is welded to outer wall 38 of the mixing drum 18 by a weld bead 138. An access hole 136 is defined in base portion 134 to provide access to mounting insert 132 for welding and removal should removal ever become necessary. The position of insert 132 relative to blade portion 84 may alternate along the length of blade portion 84. In other words, a mounting arrangement which is adjacent to arrangement 130 might appear to the left of blade portion 84 in a section view taken from the same direction as FIG. 8.

In operation, the flexible plastic mixing fin according to the invention has a smooth, slippery surface which prevents concrete from adhering and forming buildup deposits of hardened concrete. Also, since the polymeric material has good wearability and strength characteristics relative to their weight, it is possible to make the mixing fins thick enough to outwear the outer wall 38 of mixing drum 18, while weighing less than metallic mixing blades which were heretofore used. A further advantage to the plastic mixing blades according to the invention is that they can be easily molded to any shape and thickness. This allows them to be molded thicker at points where greater strength and stiffness are needed, at less expense than would be required to similarly form metallic blades.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A mobile system for mixing and dispensing a mixture such as concrete, comprising:

a vehicle;

a mixing drum mounted for rotation on a rear portion of said vehicle, said mixing drum having an outer wall which defines a mixing space within said mixing drum;

fin means within said mixing space for mixing and guiding a substance within said mixing space when said mixing drum is rotated, said fin means being constructed of a lightweight, resilient, polyurethane-based polymeric material which is flexible and resistant to abrasion, whereby the fin means will flex during operation to cause any dried concrete adhering thereto to flick off and the weight of the system is reduced in comparison to systems which were heretofore known; and means for securing said fin means to said outer wall.

2. A system according to claim 1 wherein said fin means is constructed from a fiber-reinforced polymer.

3. A system according to claim 1, wherein said polymeric material tends to wear smooth rather than rough.

4. A system according to claim 1, wherein said fin means has a smooth external surface, thereby permitting efficient removal of material from said fin means during and after use.

5. A system according to claim 1, wherein said fin means comprises, in cross-section, a substantially straight blade portion and a curved inner fin portion having an inside edge, said inside edge defining an orifice through which material may pass.

6. A system according to claim 5, wherein said fin means comprises at least one first portion where said curved inner fin portion curves rearwardly, and at least one second portion where said curved inner fin portion curves in a second, forward direction.

7. A system according to claim 5, wherein said curved inner fin portion comprises a thickened reinforced bend portion at a location where said curved inner fin portion is joined to said blade portion.

8. A system according to claim 1, wherein said fin means comprises at least a first fin section and a second fin section, and means for joining said first fin section and said second fin section.

9. A system according to claim 8, wherein said joining means comprises at least one bolt-nut connection which extends through said first fin section and said second fin section.

10. A system according to claim 9, wherein said second fin section has a reinforced offset portion for supporting an end of said first fin section, and said bolt nut connection extends through said reinforced offset portion.

11. A system according to claim 9, further comprising a reinforcement strip extending along an interface between said first fin section and said second fin section, said bolt-nut connection extending through said reinforcement strip.

12. A system according to claim 8, wherein said joining means comprises a snap pin joint.

13. A system according to claim 12, wherein said joining means further comprises a locking key for securing said snap pin joint in a fastened position.

14. A system according to claim 1, wherein said securing means comprises a metal insert which is connected to said fin means; and means for connecting said metal insert to said outer wall.

15. A system according to claim 14, wherein said connecting means comprises a weld.

16. A system according to claim 14, wherein said metal insert comprises a plurality of anchor members connected to said connecting means, and flexible means for joining said anchor members, whereby said metal insert is constructed to adjust to contraction of said polymeric material during manufacturing.

17. A system according to claim 14, further comprising at least one washhole defined in said metal insert for use during cleaning.

18. A system according to claim 14, wherein said fin means includes a base portion, and said metal insert comprises a washer-like member molded into said base portion.

19. A system according to claim 18, wherein said base portion has an access hole defined therein for exposing said washer-like member.

20. An assembly which is adapted for mounting inside a mixing space which is defined by an outer wall of a mixing drum in a mobile system for mixing and dispensing a mixture such as concrete, comprising:

fin means for mixing and guiding a substance within the mixing space when the mixing drum is rotated, said fin means being constructed of a lightweight resilient, polyurethane-based polymeric material which is flexible and resistant to abrasion, whereby the fin means will flex during operation to cover any dried concrete adhering thereto to flick off and the weight of a system can be reduced in comparison to systems which were heretofore known; and means adapted for securing said fin means to said outer wall.

21. An assembly according to claim 20, wherein said fin means is constructed from a fiber-reinforced polymer.

22. An assembly according to claim 20, wherein said polymeric material tends to wear smooth rather than rough.

23. A system according to claim 20, wherein said fin means has a smooth external surface, thereby permitting efficient removal of material from said fin means after use.

24. A system according to claim 20, wherein said fin means comprises, in cross section, a substantially straight blade portion and a curved inner fin portion having an inside edge, said inside edge defining an orifice through which material may pass.

25. An assembly according to claim 24, wherein said fin means comprises at least one portion where said curved inner fin portion curves rearwardly, and at least one second portion where said curved inner fin portion curves in a second, forward direction.

26. A system according to claim 24, wherein said curved inner fin portion comprises a thickened reinforced bend portion at a location where said curved inner fin portion is joined to said blade portion.

27. A system according to claim 20, wherein said fin means comprises at least a first fin section and a second fin section, and means for joining said first fin section and said second fin section.

28. An assembly according to claim 27, wherein said joining means comprises at least one bolt nut connection which extends through said first fin section and said second fin section.

29. An assembly according to claim 28, wherein said second fin section has a reinforced offset portion for supporting an end of said first fin section, and said bolt nut connection extends through said reinforced offset portion.

30. An assembly according to claim 28, further comprising a reinforcement strip extending along an interface between said first fin section and said second fin section, said bolt nut connection extending through said reinforcement strip.

31. An assembly according to claim 27, wherein said joining means comprises a snap pin joint.

32. An assembly according to claim 31, wherein said joining means further comprises a locking key for securing said snap pin joint in a fastened position.

33. A system according to claim 20, wherein said securing means comprises a metal insert which is connected to said fin means, and means adapted for connecting said metal insert to said outer wall.

34. An assembly according to claim 33, wherein said connecting means comprises a weld.

35. An assembly according to claim 33, wherein said metal insert comprises a plurality of anchor members connected to said connecting means, and flexible means for joining said anchor members, whereby said metal insert is constructed to adjust to contraction of said polymeric material during manufacturing.

36. An assembly according to claim 33, further comprising at least one washhole defined in said metal insert for use during cleaning.

37. An assembly according to claim 33, wherein said fin means includes a base portion, and said metal insert comprises a washer-like member molded into said base portion.

38. An assembly according to claim 37, wherein said base portion has an access hole defined therein for exposing said washer-like member.

* * * * *